US005168905A

United States Patent [19]

Phallen

[11] Patent Number: 5,168,905

[45] Date of Patent: Dec. 8, 1992

[54] PRECISION FILLING MACHINE

[75] Inventor: Iver J. Phallen, Youngstown, N.Y.

[73] Assignee: Oden Corporation, Buffalo, N.Y.

[21] Appl. No.: 585,384

[22] Filed: Sep. 20, 1990

Related U.S. Application Data

[63] Continuation of Ser. No. 270,277, Nov. 14, 1988, abandoned.

[51] Int. Cl.[5] ..... B65B 3/36

[52] U.S. Cl. ..... 141/1; 141/102; 141/103; 141/129; 141/177; 141/235; 141/237

[58] Field of Search ..... 141/1, 100, 83, 102, 141/103, 129, 177, 178, 179, 234-239, 387, 388; 417/440, 397

[56] References Cited

U.S. PATENT DOCUMENTS

| | | | |
|---|---|---|---|
| Re. 23,830 | 5/1954 | Mojonnier | 222/67 |
| 568,522 | 9/1896 | Conover | 417/440 X |
| 1,639,961 | 8/1927 | Peterson | 417/440 X |
| 1,743,304 | 1/1930 | Angell | 141/103 X |
| 1,753,562 | 4/1930 | Ferris | 417/440 X |
| 2,263,551 | 11/1941 | Armstrong et al. | 141/179 X |
| 2,660,336 | 11/1953 | Coffey et al. | 417/440 X |
| 3,237,661 | 3/1966 | Rosen | 141/180 |
| 3,357,606 | 12/1967 | Kahlenberg | 141/236 |
| 3,402,523 | 9/1968 | Mojonnier | 141/102 X |
| 3,587,677 | 6/1971 | King | 141/177 X |
| 3,651,836 | 3/1972 | Johnson | 141/103 |
| 4,411,295 | 10/1983 | Nutter | 141/237 X |

FOREIGN PATENT DOCUMENTS 2534554 2/1977 Fed. Rep. of Germany ..... 141/103

*Primary Examiner*—Henry J. Recla
*Assistant Examiner*—Casey Jacyna
*Attorney, Agent, or Firm*—John C. Thompson

[57] ABSTRACT

An in-line liquid filling machine and method of filling containers. In certain embodiments a a single row of containers is indexed past a plurality of filling nozzles which are in turn interconnected with a manifold which receives a single fill of material from a dosing structure. If all nozzles are dispensing simultanteously a total fill of material is received at one time, the nozzles distributing aliquot parts of the total fill to the row, with each container sequentially passing under each filling nozzle. If only alternate groups of nozzles are to be filling at any one time, the fill delivered by the dosing structure is proportionate to the total fill as the nozzles dispensing the fill are proportionate to the total number of nozzles. The dosing structure typically includes a single pump. Filling-time and indexing-time cycles typically are performed sequentially, but in certain embodiments they may be performed simultaneously. Thus, in a dual lane machine while only a single pump is utilized, the containers associated with one row of nozzles are receiving the aliquot parts of a total fill being dispensed by the nozzles while the containers associated with the row of nozzles for the second lane are being indexed.

10 Claims, 4 Drawing Sheets

Fig. 5.
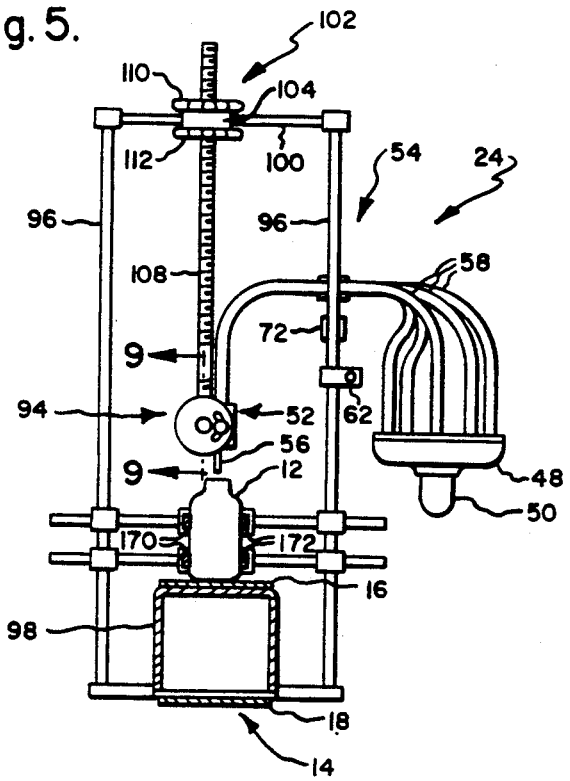
Fig. 6.
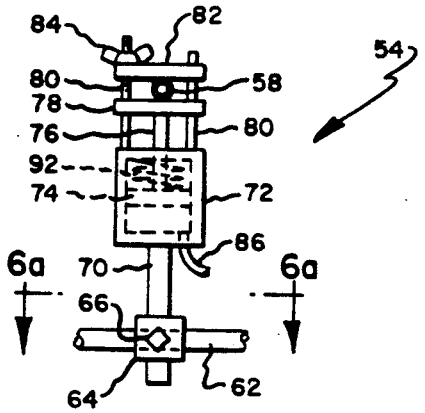
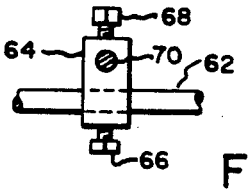
Fig. 6a.
Fig. 8.
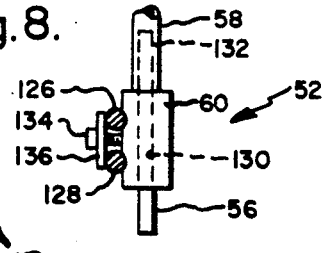
Fig. 7.
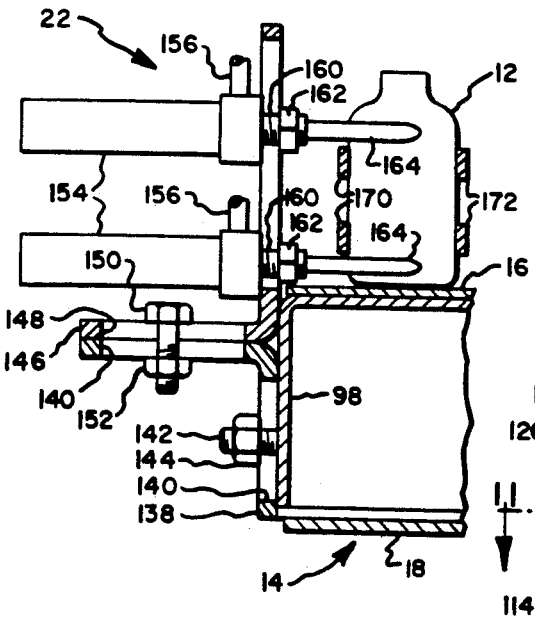
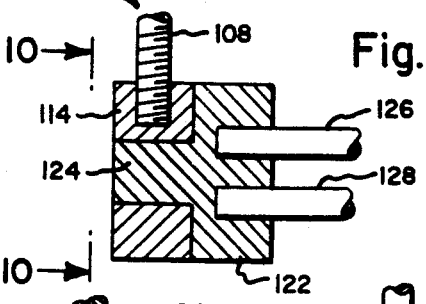
Fig. 9.
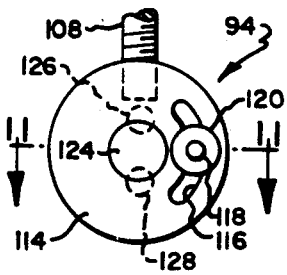
Fig. 10.
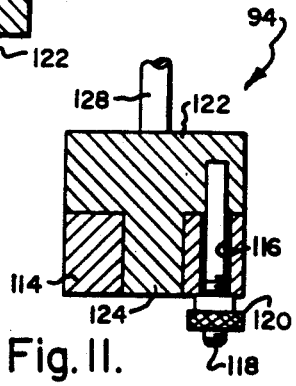
Fig. 11.

PRECISION FILLING MACHINE

TECHNICAL FIELD

The present invention relates generally to a liquid filling apparatus and method of filling a plurality of containers arranged in a line, and more particularly to an apparatus and method for delivering aliquot parts of a total fill of liquid to a group of containers which are arranged in a line during a fill time period, and wherein the group of containers are indexed one position during an index time period, the fill time and index time periods being sequentially repeated to cause the containers within the group to receive a total fill of material.

BACKGROUND OF THE INVENTION

Liquid filling machines which fill containers in a line are called in-line liquid fillers. Such fillers are, by definition, intermittent motion devices. Typically, containers are conveyed into the filling machine as a group. Each group is held stationary while each container within the group is completely filled with the requisite total fill of liquid. The total fill is generally determined by the use of a separate positive displacement pump for each container to be filled. Alternately, the fill dose may be based upon timed flow from a gravity reservoir elevated above the filling valves, or by a timed flow from a pressurized reservoir. In nearly all cases, the entire fill is placed into the container at one stop and then the entire group of containers is conveyed out of the machine to be replaced by a new group of empty containers, as in the Pro/Fill 3000 automatic fillers manufactured by the Oden Corporation of Buffalo, N.Y.

In a few known cases, containers may be partially filled at several locations as they move through the machine, but in these cases, a separate filling apparatus, generally a pump, is used at each filling location within the machine (see U.S. Pat. Nos. 3,648,741 and 3,651,836).

In all cases, a separate mechanical and/or electronic adjustment is required to establish the correct fill for each container position.

The common use of a separate filling apparatus and control for each filling position within the filling machine requires a complete duplication of hardware at each position. This duplication includes pumps, feed lines, drives, fill dose controls and filling shut-off valves or nozzles.

With in-line filling machines of the type described, several methods are utilized to enhance machine performance and utility or increase container throughput speeds. It is common practice to lower the filling nozzles into the bottom of the container and raise them up out of the bottle as the level of the liquid product rises in the container. This cycle is a time consuming and error prone practice and requires apparatus which can be complex and costly. It is frequently necessary, however, in order to allow adequate or enhanced liquid flow rates into containers without associated foaming of the liquid or turbulence induced gas entrainment into the liquid as it enters the container, leading in either case to overflow of the container during the filling process from foaming or boilout.

Another means of increasing container throughput in an in-line filling machine is to add filling positions. This requires additional duplication of lines, hardware, pumps and controls for each additional container filling position and makes the machine more complex and costly. Moreover, as each additional filling position is added, total machine output increases at a decreasing rate per added station and eventually begins to decrease in total containers per minute of output. This is because the indexing or transfer time of containers into and out of the machine becomes an ever greater proportion of the machine's total cycle time as filling positions are added.

The addition of diving nozzles (bottom-up container filling apparatus) and additional filling stations has the further negative effect of complicating and lengthening the initial set-up times required to make a filling machine operable with a particular liquid and container, and of complicating and lengthening the changing of the machine over from one particular liquid and container to another.

Another means of increasing container throughput in in-line liquid filling machines of known types is to decrease the liquid filling time by using the largest diameter filling nozzles possible consistent with the size of the container opening or neck. The use of larger nozzles reduces fluid velocity per unit area as it enters the container, thus reducing splash out effects. An unwanted result of this method is the much greater tendency of the filling nozzles to drip product onto the containers or machine between filling periods.

OBJECTS AND SUMMARY OF THE INVENTION

It is a primary object of the present invention to overcome the numerous disadvantages of in-line filling machines as set forth above. More specifically, it is a primary object of the present invention to minimize and simplify the number of filling pumps or apparatus used in an in-line liquid filling machine; to minimize and simplify the mechanical and/or electronic controls for each filling position in an in-line liquid filling machine; to reduce or eliminate the additional pumps, valves, feed lines, fittings, controls and other hardware associated with the addition of filling stations to an in-line liquid filling machine; to largely eliminate the need to enter a container with a filling nozzle and track the rising fill level within the container to reduce product foam or splash-out; to eliminate the decreasing rate of output improvement found in in-line liquid fillers of known type as filling positions are added; to substantially and significantly speed up and simplify filler machine preparation for operation and machine changeover to new products and containers; to largely eliminate the problems of product drip associated with the use of larger diameter filling nozzles; and to simplify and reduce the clean up and washout time of the machine fluid flow pathway which is necessary to change from one liquid to another.

The present invention relates to an unique and novel means to utilize only one filling pump or liquid product flow source to accurately fill many containers with the need to adjust only one fill dose control, and with the ability to add filling valves as required to subdivide the liquid flow as necessary to allow efficient filling without splash-out or foam without the need for the filling nozzles to enter the container, and without decreasing machine output speeds. The present invention provides for moving containers through the filling machine in a stepwise sequential manner in which each container passes under, stops at and is, in turn, partially filled at, each filling valve or nozzle. It will be understood that each container receives a fractional part of the total required fill amount at each filling station, said fraction to be approximately as that one station bears to the total number of filling stations fitted to the machine. In other words, if the machine has four stations, the fractional fill delivered at each station is approximately one-fourth of the total fill.

Because each container moves only the distance equivalent to its own diameter to reach the next filling position in the machine, the total container transfer time through the new machine type is, in the worst case, the same as the transfer time of containers moved as a group through a machine of known type with an equivalent number of filling positions.

In the present invention, each cycle of the machine consists of transferring all containers within the filling machine the equivalent of one container diameter. This is followed by filling each container with an aliquot part of a total fill of liquid. The container index and filling process is repeated again and again. The filling consists of accurately delivering one complete fill dose to a manifold with multiple outlet ports which subdivides the dose into aliquots of lesser amount at correspondingly lower flow rates. Product distributor outlets are in turn connected to the outlet ports. The aliquots need not be precisely the same from manifold outlet port to manifold outlet port, but only of the same amount from fill cycle to fill cycle. This repeatable but not equal subdivision is accomplished by constructing the manifold and product distributor outlets in a manner such that the materials of construction are essentially stable and unchanging relative to the liquid being dispensed, and so that each outlet is substantially similar to every other. Because each outlet delivers a repeatable fractional fill dose with each filling cycle, moving a container under each outlet in succession will result in that container being successively filled with fractional fill amounts until, after it has passed under all outlets, it is completely filled. Since each container passes under each product distributor outlet in turn, it can be mathematically shown that the inaccuracy of the total fill from cycle to cycle will be the sum of the inaccuracies at each product distributor outlet and that these inaccuracies will sum to equal the inaccuracy of the total fill dose as provided to the product distributor from cycle to cycle. Thus, the relative filling accuracy of the new filling machine design is dependent only upon the ability of a pump, in the preferred embodiment, to deliver a repeatable total fill dose to the product distributor with a defined accuracy.

BRIEF DESCRIPTION OF THE DRAWINGS

FIG. 5 is a side elevational view of the machine shown in FIG. 3, this view being taken generally along the line 5—5 in FIG. 3.

FIG. 6 is a side view of a filling nozzle shut-off valve, this view being taken generally along the line 6—6 in FIG. 3.

FIG. 6a is a view taken generally along the line 6a–6a in FIG. 6.

FIG. 7 is a view of the adjustable stop assembly of this invention, this view being taken generally along the line 7—7 in FIG. 3.

FIG. 8 is a view taken generally along the line 8—8 in FIG. 4 showing the manner in which a nozzle may be mounted.

FIG. 9 is a view taken generally along the line 9—9 in FIG. 5 illustrating one end of a nozzle support assembly.

FIG. 10 is a view taken generally along the line 10—10 in FIG. 9.

FIG. 11 is a view taken generally along the line 11—11 in FIG. 10.

DETAILED DESCRIPTION

Figure 1:
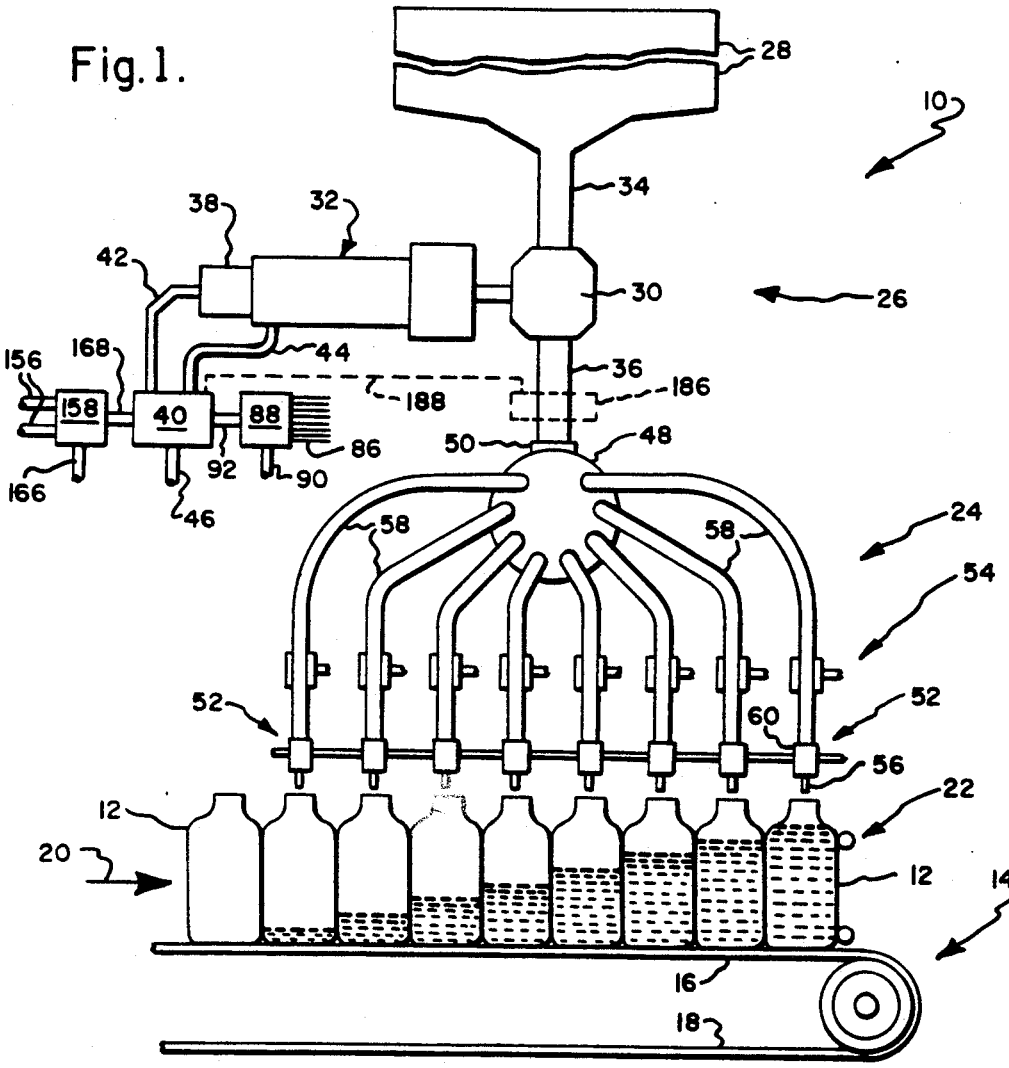
FIG. 1 is a somewhat schematic view of a first embodiment of the filling machine of the present invention.

While a number of differing embodiments are shown in the drawings, these embodiments differ from one another primarily in the layout of the components. Therefore in the following description common parts in the various embodiments will be referred to by the same reference numerals in the text as well as in the drawings.

FIRST EMBODIMENT

Figure 2:
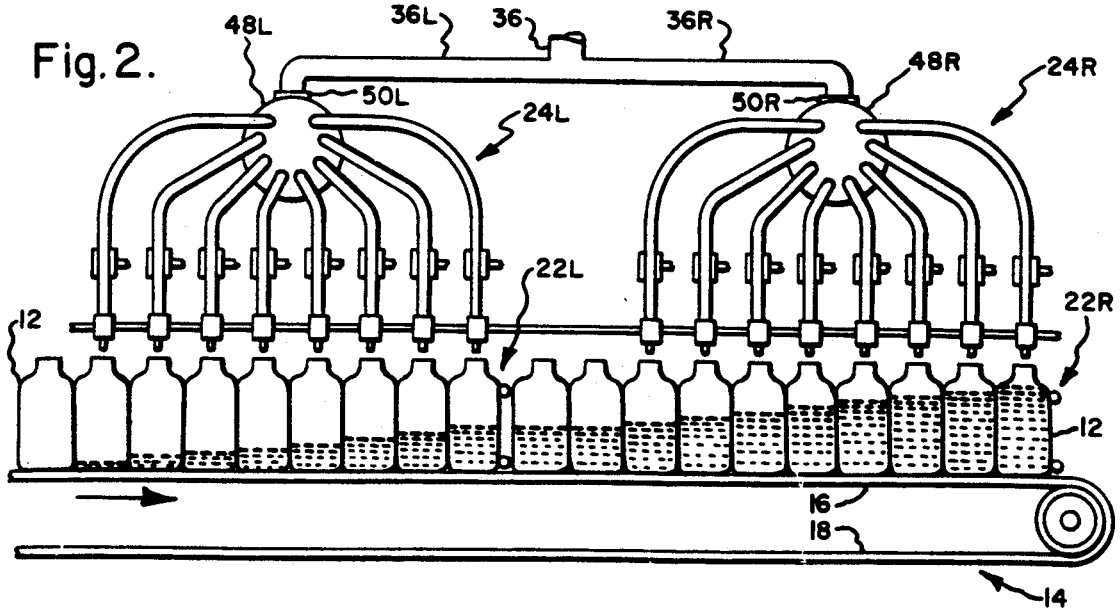
FIG. 2 is a partial schematic view of a second embodiment of the filling machine of this invention.
Figure 3:
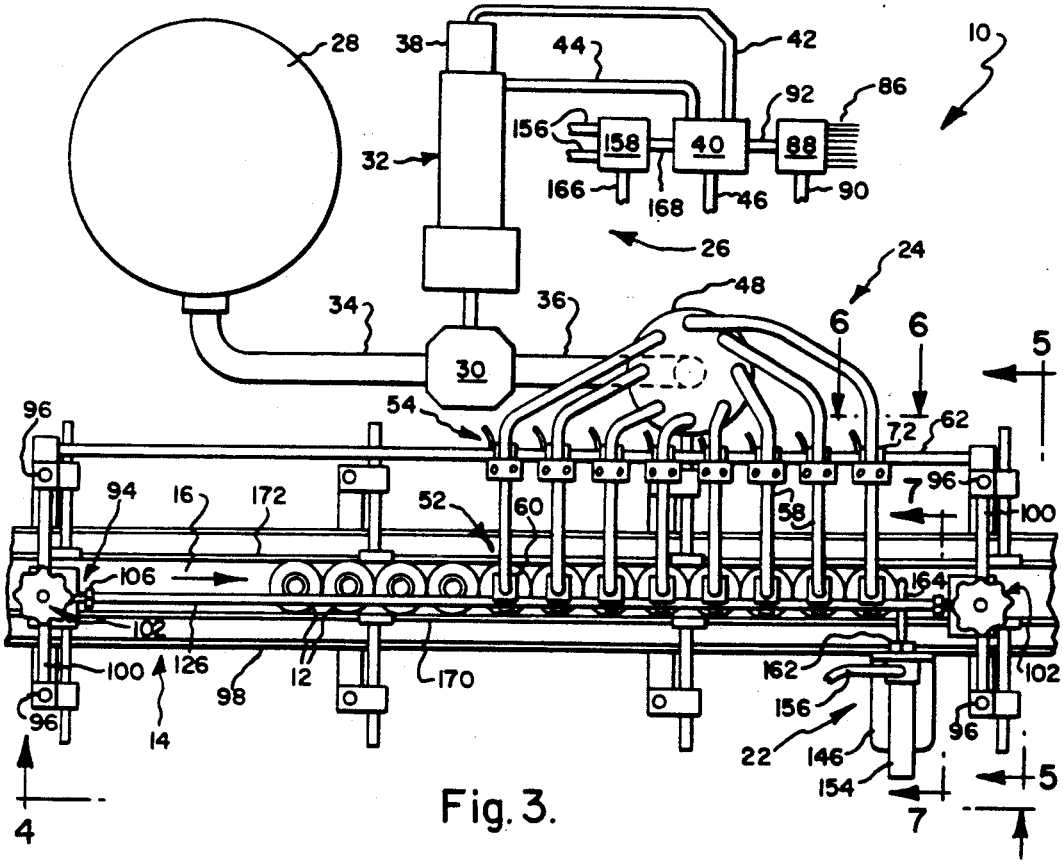
FIG. 3 is a top plan view of the first embodiment of the filling machine.
Figure 4:
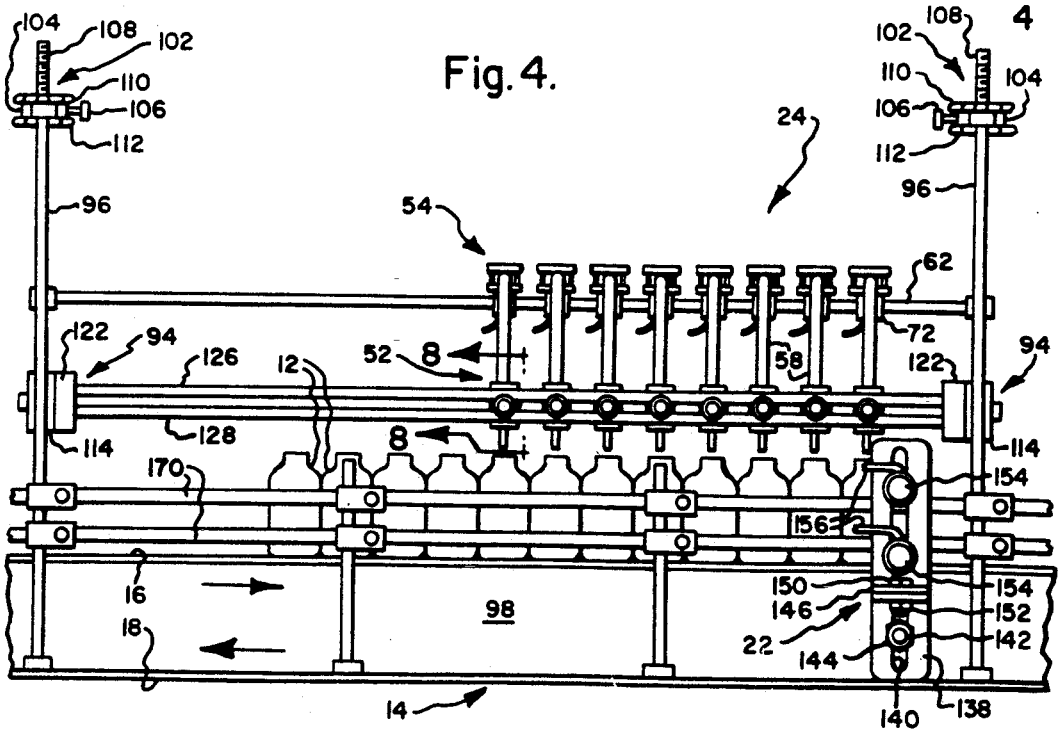
FIG. 4 is a front elevational view of the machine shown in FIG. 3, this view being taken generally along the line 4—4 in FIG. 3, parts being eliminated for purposes of clarity.

Referring first to FIGS. 1, 3 and 4, wherein a first embodiment of the present invention is illustrated, the filling machine of this invention is indicated generally by reference numeral 10. The filling machine of this invention is of the type generally referred to as an in-line filling machine. Thus, a plurality of containers 12 of uniform size are disposed adjacent to each other in a row, adjacent containers contacting one another. The row of containers engages conveying means indicated generally at 14, the conveying means including a continuously running conveyor belt having upper and lower flights 16, 18, respectively, the upper flight adapted to be driven in the direction of the arrow 20. The conveying means also includes novel adjustable stop means indicated generally at 22 and more fully shown in FIG. 7. The novel adjustable stop means will be described below. The filling apparatus further includes, as major components thereof, a product distributor indicated generally at 24 and dosing means indicated generally at 26. In the embodiment illustrated in FIGS. 1 and 2 the dosing means is capable, during each complete cycle of operation, of delivering a total fill of a liquid to the product distributor. For the purposes of this application a "total fill of liquid" means the quantity (or weight) of liquid with which one container of the row of containers is to be filled.

The dosing means in the embodiment shown in FIG. 1 includes a product reservoir 28, a pump 30, a pump drive 32, a fluid line 34 running from the reservoir 28 to the pump 30, and a fluid line 36 running from the pump to the product distributor 24. The reservoir is preferably a level controlled reservoir. The pump may be a rotary positive displacement pump such as a gear pump or lobe pump. While a rotary positive displacement pump is illustrated in FIG. 1, it should be appreciated that other forms of dosing means may be employed. Thus a diaphragm pump, vane pump, piston pump, progressive cavity pump or peristaltic pump may be utilized. Alternatively, the fill dose may be based upon timed flow from a gravity reservoir or a pressurized reservoir. If a rotary positive displacement pump is utilized it is preferably driven by a DC servo motor and gear train, both being indicated generally at 32. The rotational output of the pump drive is controlled by a suitable encoder/sensor 38 mounted on one end of the pump drive motor, the encoder/sensor being in turn connected to a suitable electronic controller 40 by a wiring harness 42. By use of the encoder/sensor the controller 40 can initiate the flow of current through line 44 to motor 32 to precisely control the output of the motor to ensure proper fill volume and/or flow rate of the pump. The controller 40 is in turn connected to a source of electrical power through power line 46. The dosing means described above is of the type presently used to fill a single container and is sold under the trademark "PRO/FILL" by the ODEN Corporation.

The product distributor in the embodiment illustrated in FIG. 1 includes a manifold 48 having an inlet port 50 and a plurality of outlet ports (not shown). A product distributor outlet indicated generally at 52 is connected to each manifold outlet port. Each product distributor outlet includes in part a filling nozzle shut-off valve indicated generally at 54 and an outlet nozzle 56. In the embodiment shown in FIGS. 1 and 3 through 6 a filling nozzle shut-off valve of a pinch valve construction is illustrated. However, it should be appreciated that other filling nozzle shut-off valves may be utilized, and another form is shown in U.S. patent application No. 07/270,277 entitled "Diaphragm Valve" and filed concurrently with this application and commonly assigned, the subject matter of which is incorporated herein by reference thereto. The filling nozzle shut-off valve 54 as illustrated of each product distributor outlet 52 will engage a fluid line 58 which extends from an outlet port of the manifold 48 to a nozzle mounting block 60. As is conventional, the pinch valves 54 of the outlets 52 are adjustably mounted on a transverse mounting rod 62 by mounting blocks 64. The rod 62 can be mounted in any manner, and one form of mounting is illustrated in FIGS. 4 and 5. Each mounting block 64 is provided with first and second fastening elements 66, 68, the fastening element 66 securing the mounting block 64 to the mounting rod 62 in various positions of adjustment, and the fastening element 68 securing a valve mounting rod 70 to the mounting block in various positions of adjustment. Carried by the valve mounting block 64 is a valve actuator including an air cylinder 72 which receives piston 74 and piston rod 76, the piston rod 76 projecting outwardly of the air cylinder and engaging a slideable cut-off block 78. Disposed to either side of the piston rod 76 are dowels 80, the ends of the dowels remote from the air cylinder 72 receiving a stop 82 which is adjusted on the dowels by an adjusting member 84. Each air cylinder is in turn connected with an air line 86 which extends from an air manifold/valve 88. Air is introduced into the manifold/valve from a source of pressurized air through an air line 90. The manifold valve 88 is electrically operated and may be shifted between open and closed positions. When a proper signal is received by the manifold 88 from the controller 40 by bus 92, each valve will be shifted to an open position and air will flow from line 90 through the various air lines 86 to the air cylinders 72 to cause the cut off block 78 to be shifted towards the stop 82 to stop the flow of liquid through the fluid line 58. When the combined valve and air manifold 88 is caused to be shifted to its other position by the controller 40, a spring 92 within each cylinder 72 will cause the piston to be retracted thereby permitting flow through the line 58. While a separate valve actuator is illustrated for each valve 54, a common valve actuator may be employed.

The nozzle mounting block 60 is supported by novel adjustable mounting means indicated generally at 94 and best shown in FIGS. 3-5 and 8-11. The adjustable mounting means 94 includes right and left laterally spaced apart vertical support assemblies each of which includes front and rear vertical rods 96, the lower ends of which are rigidly secured to a stationary conveyor frame 98. A fore and aft horizontally extending support rail 100 is connected to the upper ends of each of the vertical rods 96. Adjustably secured to rail 100 for fore and aft adjustable positioning is a vertically extending support rod assembly indicated generally at 102. The support rod assembly includes a mounting block 104 which may be adjustably positioned along the horizontally extending support rail 100 by means of a turn screw 106. The mounting block in turn is provided with a vertically extending aperture which receives a threaded rod 108, which threaded rod is held in various positions of vertical adjustment by upper and lower nuts 110, 112 which engage both the threaded rod 108 and mounting block 104. The lower end of the vertically extending threaded rod 108 is threaded into an aperture in an annular mounting member 114. The annular member 114 is provided with an arcuate slot 116 to one side, which slot 116 receives a threaded pin 118 the pin being capable of being secured in various positions of adjustment by a knurled nut 120. The end of the pin 118 remote from the nut 120 is received in a cylindrical flange portion 122 of a tilting mounting member, the tilting mounting member also including a reduced diameter cylindrical concentric portion 124 which is concentric with the flange portion 122 and extends parallel to the pin 118, the reduced diameter cylindrical portion 124 being received with a cylindrical aperture in the annular mounting member 114. Upper and lower parallel rods 126, 128 are suitably secured to the tilting mounting members 122, 124 and extend parallel to the upper flight 16 of the conveyor as can best be seen from FIG. 4.

The nozzle mounting block 60 is provided with a through bore 130, through which a filling nozzle tube 132 is fitted to provide liquid flow from the attached fluid line 58. The outlet end of the filling nozzle tube, further identified at 56, serves as the outlet nozzle. The mounting block is provided with two small circular cutouts on one side, which cutouts are adapted to be mated with sides of the upper and lower rods 126, 128 the mounting block may be secured to the rods 126 and 128 in various positions of horizontal adjustment by a threaded fastener 134 which is received within a suitable threaded aperture in the block 60 between the cutouts which receive the rods 126, 128. The fastener 134 carries washer 136.

It should be observed at this point that by using the foregoing adjustable mounting means that the outlet nozzles 56 of the various product distributor outlets can be positioned more closely together or spaced further apart on the rods 126, 128 by simply loosening the threaded fastener 134 of the mounting block 60 of each outlet 52, by moving the mounting block 60 to the desired position, and then by tightening fastener 134. In addition, the nozzles can be raised or lowered by suitably rotating nuts 110, 112. In addition, the nozzles as well as the rods 126, 128 can be moved towards or away from the front of the machine by sliding the mounting block 104 on the horizontally extending support rail 100 to its desired position. If it is desired to dispense the liquid down one side of a container, the nozzles 56 can be rotated to place it in this angle by simply loosening the knurled nut 120 and rotating the tilting mounting member 122, 124 to its desired position.

As previously indicated, the row of containers will engage an adjustable stop indicated generally at 22, and best shown in FIG. 7. The novel adjustable stop 22 has been developed in view of the wide number of container sizes which may be utilized with the filling machine of the present invention. Thus, the adjustable stop includes an L-shaped mounting bracket 138 which is provided with elongaged slots 140 on each of its legs. A stud 142 carried by the conveyor frame 98 is adapted to pass through one of the slots 140 so that the mounting bracket can be positioned in various positions of vertical adjustment by tightening down nut 144 carried by the stud 142. An L-shaped stop supporting bracket 146 is also provided with slots 148 in each of its legs. The bracket 146 is adjustably mounted on the upper horizontal leg of the L-shaped mounting bracket 138 by passing a suitable bolt 150, through the slots 148 and 140 and securing it in place with nut 152. It is a feature of this invention that two stops are adjustably mounted on the stop supporting bracket. By utilizing two stops it is possible to contact the container at two relatively rigid locations, spaced above and below the center of gravity of the container to ensure proper stopping of the container. Each stop is carried by an air cylinder assembly, each of the stop air cylinder assemblies including a cylinder 154 which is connected with an air line 156 to an air manifold/valve 158. The air cylinder 154 is adjustably secured to the stop supporting bracket 146 by a threaded sleeve 160 which is received within the slot 148 in the vertically extending arm of the stop supporting bracket 146, the sleeve being held in various positions of vertical adjustment by nut 162. A piston rod 164 extends through the sleeve and is normally spring biased to an extended position, which position is shown in FIG. 7. Thus, the piston rod is caused to be extended by a spring (not shown) disposed within the cylinder 154 and which bears against the piston within the cylinder to cause the piston rod 164 to be extended. If it is desired to cause the piston rod 164, which acts as the stop, to be retracted, it is only necessary to introduce air under pressure through the air line 156 to cause the piston and piston rod to shift to the left as viewed in FIG. 7. The air manifold/valve 158 is in turn connected with an air line 166 and is suitably controlled by bus 168 from the controller 40.

When the filling machine of this invention is initially set up, a row of containers will be placed on the upper flight 16 of the conveyor in side-by-side position as illustrated in FIG. 1. At this point, it should be noted that the containers are disposed between forward and rear guide rails 170, 172, which are suitably interconnected to the conveyor frame 98 in a manner not material to the present invention. The stops or piston rods 164 will be in their extended position, and the guide rails 170, 172 and/or stop supporting bracket will be adjusted so that the leading end of the stop just passes the centerline of the containers as illustrated in FIG. 7. In addition, the air cylinders are also vertically adjusted so that the lowermost stop will engage the leading container of the row at a location just above the bottom as illustrated in FIG. 7, and the uppermost stop engages the container at a location immediately below the shoulder. It has been found that these portions of a container, even when made of light weight plastic materials, such as a two liter beverage bottle, are relatively rigid and will result in accurate positioning of the container. The nozzles 56 are now suitably positioned with respect to the tops of the containers so that each nozzle is spaced slightly above the top of an associated container and are typically concentric with the opening in the container.

After the adjustable stops 164 are properly positioned and the nozzles 56 are properly positioned with respect to the containers, it is then necessary to run through a number of cycles of the filling machine in order to complete the setup. Thus, the rotary positive displacement pump motor 32 is rotated a predetermined number of revolutions which are believed to be suitable to deliver a total fill of liquid by the pump to the product manifold 48. At the same time that the motor is being operated the filling nozzle shut-off valves 54 will be shifted to their open position through suitable actuation of the manifold/valve 88. At the completion of the operation of the pump motor the valves will then be shifted back to their closed position. Aliquot parts of the total fill will be delivered by the nozzles 56 to the various containers 12 associated with the nozzles of product distributor outlets 52. The above takes place during a fill time period. At the completion of the fill time period, the controller 40 will send a signal through bus 168 to manifold/valve 158 to cause the stops 164 to be retracted to permit movement of the containers with the upper flight 16 of the conveyor belt. After the leading container, shown to the right in FIG. 1, has been discharged, the stop 164 will be again extended to cause the next following container to engage the stops and to stop the movement of the row of containers on the upper belt 16. This will complete an index time period. The containers will now be sequentially filled with aliquot portions and indexed to the next adjacent position. While these steps are being initially conducted, the machine operator will check the containers for excess foam and/or boil out. If excess foam or boil out are observed, the operator will discontinue operation, and may connect additional product distributor outlets to the outlet ports of the manifold to subdivide the total fill into further aliquot parts. By adding additional product distributor outlets, it is possible to reduce the volumetric flow rate through each nozzle thereby introducing the product more gently into the containers. Thus, if the machine is initially set up with six nozzles and excessive foaming is observed, additional nozzles may be added, for example six more. If excessive boil out and/or foaming is not detected with the employment of 12 nozzles, a complete sequence of steps will now be run until one container has been filled by all of the product distributor outlets. The fill of the container will now be checked and, if necessary, the controller will be adjusted to either increase or decrease the total fill of fluid delivered by the dosing means to properly fill a container. In many cases it is legitimate to turn down pump speed, i.e., reduce flow rate, to control foam or boilout—for example in cases of smaller fill volumes such as 1 or 2 ounces.

Because, in the present invention, product flow can be subdivided easily and at low cost, requiring only a flexible product distributor outlet and because increasing product flow division, that is, increasing the number of filling positions, does not affect the output rate of the new machine design, it will be understood that product distributor outlets can be freely added to reduce the absolute flow rate of product entering a container to such a low level as to virtually eliminate the possibility of foaming or splash-out during aliquot step fills, and that this virtue of the new design substantially eliminates the need for a bottom-up filling apparatus to lower filling nozzles into the container for controlled no splash filling. The elimination of the need for a diving nozzle mechanism greatly simplifies machine design, reduces machine cost, and simplifies and shortens machine adjustment and setup for operation.

The ability to freely add filling product distributor outlets to reduce product flow rate at each filling position during step filling to eliminate foaming and splashing allows the diameter of the filling nozzles to be drastically reduced. This reduction in nozzle diameter speeds product cut-off at the end of an aliquot dose and greatly reduces the possibility of product drip from the filling nozzle tube tip during the period between filling. This reduction of drip potential is further enhanced by the method of container motion in the new machine design in that the time of index which intervenes between each successive filling cycle is much lower when the containers are being advanced only one container diameter rather than many container diameters as is the case with machines of known type.

The ability to freely add product distributor outlets to reduce product flow rate, allowing the elimination of a bottom-up filling mechanism, further allows the nozzle tubes to be much shorter than in machines of known type. While nozzle tubes of conventional machines are generally 6 to 12 inches in length, the nozzle tubes on the new design are rarely over one inch in length. This radical reduction in length leads to a further substantial reduction in the possibility of product drip from the filling nozzle during the period between filling.

The ability to freely add outlets to reduce product flow rate at each filling position during step filling to eliminate foaming and splash-out or boilout allows the flow rate at which the entire fill volume is delivered to the product distributor during each fill period of the machine cycle to be at the maximum possible as limited only by the flow capacity of the pump or other product flow source designed into the particular machine. Essentially, this means that regardless of product characteristics, the machine can almost always be operated at its maximum speed potential.

Because, in the preferred embodiment of the new machine design, only one filling pump or other product flow source is required to do the job of many such pumps or flow sources in known designs, only one fill dose amount control is required. This provides a corresponding reduction in machine complexity, machine cost and machine fill dose set-up time. Likewise, because only one pump is required, only one flow rate adjustment need be made during the machine set-up procedure as contrasted with many designs of known type where the flow rate of each pump at each filling position must be adjusted.

Because the new design uses only one filling pump to do the job of many such pumps in conventional designs, the liquid flow pathway of the new design is radically simplified. The reduction in pumps, pump drives, plumbing, fittings and hoses required by the present apparatus greatly simplifies the design of the filling machine, reduces machine cost, reduces machine set-up and changeover time, enhances machine reliability, and reduces the time required to clean the liquid flow pathway after filling is completed.

Because the filling pump or other product flow source is connected to many flow outlets in the new design, the system pressure remains very low during filling. As a result, the volumetric efficiency of the pump is enhanced, and the loading on the pump drive is minimized. Further, flow rate losses with increasing product viscosities are minimized, and preservation of product integrity as it passes through the liquid flow pathway is aided. All of these beneficial effects of the low pressure design characteristics of the new machine architecture can be further enhanced as required by the addition of more filling valves.

Because flow subdivision reduces the flow rate of product entering a container to essentially any level required, gentle no-foam filling is generally achievable by simply adding filling positions as required. In some few cases, even at very low flow rates, some foam may accumulate in some container shapes with some exceptionally foamy products. In these instances, because relatively small diameter nozzles can be utilized as heretofore explained, the entire nozzle mounting mechanism can be inclined or tilted by up to 30 degrees from the vertical without risk of cut-off or drip problems. This tilting results in product flowing down the side of the container neck or shoulder and onto the container wall. This, in turn, substantially reduces foaming as the liquid enters the container since the product is not impacting into the body of liquid already introduced into the container.

SECOND EMBODIMENT

In the above description of the setup and operation of the FIG. 1 embodiment, it has been assumed that only a single manifold may need to be employed. However, it has been found through experimentation that there is a practical limitation for many situations wherein only 14 product distributor outlets may be interconnected with a single manifold. However, in certain situations it may be desirable to have more nozzles, as for example, when dispensing very foamy materials at relatively rapid rates. Thus, if more than 14 nozzles are necessary to provide an adequate fill, it is only necessary to provide more than one manifold as can be seen from an inspection of FIG. 2. Thus, in the embodiment illustrated in FIG. 2, the fluid line 36 from the pump 30 is split into left and right branch lines 36L and 36R, respectively, which branch lines are in turn interconnected with the inlet port 50 of left and right manifolds 48L, 48R. The outlet ports of each of these manifolds are in turn interconnected with product distributor outlets 52 which terminate in nozzles 56 which are suitably positioned with respect to the openings in the containers 12. When using this design it is necessary to provide two stop assemblies 22L, 22R the stop assembly 22R on the right-hand side stopping those containers associated with the nozzles interconnected with the right-hand manifold 48R as well a two additional containers as shown in the figure. In this embodiment the stop assemblies 22L and 22R will be operated simultaneously and similarly the filling nozzle shut-off valves will all also be operated simultaneously. Thus, the pump will deliver a total fill of liquid to the discharge fluid line 36 and the total fill of liquid will be proportionally divided between manifolds 48L and 48R, each of which proportionate amounts will be further subdivided into aliquot portions for distribution into the various containers 12 disposed below the nozzles 56. At the completion of each fill time period, the stops will be withdrawn for a suitable length of time to permit movement of the containers, the right-hand container being discharged while the remaining containers in the row shown in FIG. 2 being indexed to the next position, then being held there in the proper position by the extension of the stops.

THIRD EMBODIMENT

Figure 12:
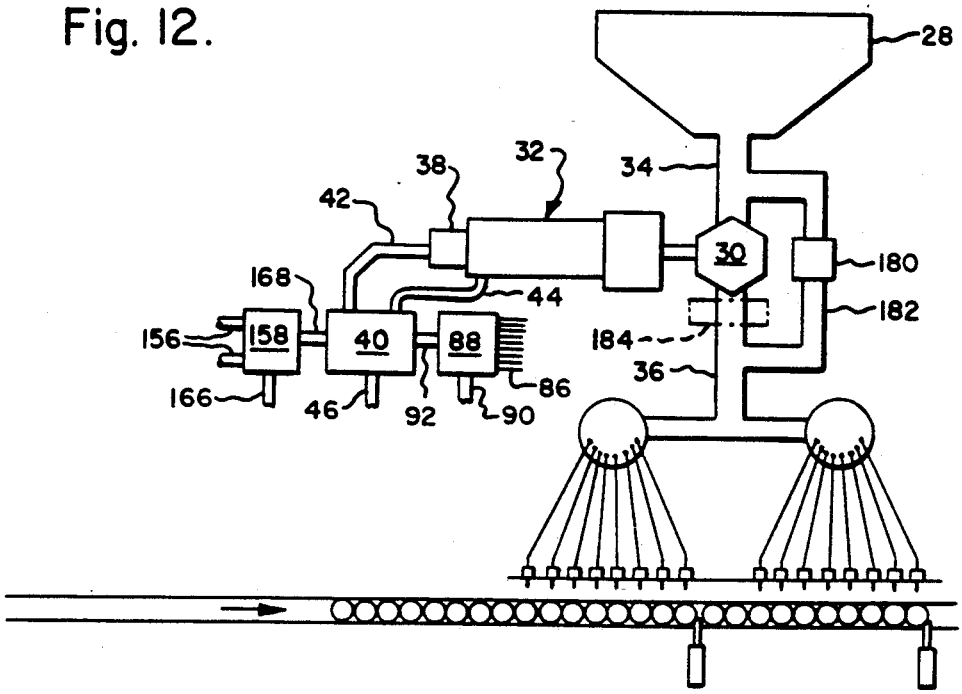
FIG. 12 is a diagrammatic view of a third structural embodiment.

In the embodiment of FIG. 12 the pump 30 is continuously operated and the total fill of fluid is controlled by a bypass valve 180 in bypass line 182 operated in conjunction with filling valve 54. When the structure shown in FIG. 12 is being utilized in a manner comparable to the device illustrated in FIG. 2, the filling nozzle shut-off valves (not shown) are shifted to their open position and immediately thereafter the bypass valve 180 is shifted to a closed position to cause fluid from the pump to be directed to the left and right manifolds 48L, 48R, and then to the containers 12 below the outlet nozzles 56. The total fill of fluid to the inlet ports on the two manifolds is completed by opening the bypass valve 180 and immediately thereafter closing the filling nozzle shut-off valves to cause liquid from the pump to then be redirected through bypass line 182. From the above it should be observed that the primary structural distinction between the embodiment of FIG. 12 and the embodiments of FIGS. 1 and 2 relate to the dosing means. Thus, instead of causing the pump 30 to be rotated a specific number of revolutions to deliver a total fill of liquid and then to be returned to a stopped condition, the pump is run continuously, its output being redirected through bypass line 182 except when fluid is to be delivered to the containers at which point the filling nozzle valves associated with the manifold are caused to be opened and then the valve 180 is closed. The valve 180 is in turn interconnected with the controller 40 by a suitable bus, not shown, and the controller is suitably programmed to properly sequence the operation of valve 180 and filling nozzle shut-off valves. At the ending of a fill time period, the controller reverses the valve sequence as previously described. The controller 40 may be programmed to register pulse-count output from encoder 38 via bus 42 to a specific total-count number, the number representing a precise incremental rotation of the positive displacement pump and, thus, resulting in a precise fill dose amount. Alternatively, a volumetric flow meter 184 (shown in dotted lines in FIG. 12) may be associated with the fluid line 36 between the pump and the inlet to the bypass 182, the volumetric flow meter being coupled to the controller for initiating those signals necessary for the proper control of the total fill of liquid. Instead of a volumetric flow meter, a mass flow meter may be utilized if it is desired to fill to a specific mass or weight. Thus, a mass flow meter comparable to the model 50 mass flow meter sold by Smith Meter, Inc. of Erie, Pa. may be utilized, this meter being disclosed in U.S. Pat. No. 4,559,833. If a mass flow meter is utilized, the valves are sequenced in the manner set forth above.

A mass flow meter may also be utilized in the embodiment of FIG. 1, the mass flow meter being indicated at 186. When a fill is to be initiated, pump 30 will be started. As material flows through meter 186 pulses will generated which will be transmitted to controller 40 through line 188. The controller will process the pulses in essentially the same manner as pulse counts received from encoder 38 and will cause the operation of pump 30 to be discontinued when the desired mass has been delivered to inlet port 50.

The structure shown in FIG. 12 may be used in a differing manner than that described above. Thus, instead of filling all containers with aliquot parts of the total fill of liquid at the same time and then indexing all containers simultaneously, it is possible to fill those containers associated with one manifold with a 50% total fill while indexing the other set of containers and then to reverse the procedure. Thus, it is possible to distribute liquid to that group of the containers associated with the left-hand manifold 48L while indexing that group of the containers associated with the right-hand manifold 48R, and vice versa. This is done by delivering aliquot parts of a 50% total fill to the group of containers associated with the group of product distributors which extend from the left-hand manifold 48L during a fill and index time period, and at the same time indexing another group of containers (formerly associated with the nozzles 56 of the right-hand manifold 48R) to cause the last container of the second group of containers to be discharged from the row of containers and the remaining containers of the second group to be indexed to their next adjacent position. At the completion of the above fill and index time period, the stops 22R for the right-hand group of containers will become engaged by the next adjacent container in the second group, and the stop 22L associated with the left-hand group of containers will be retracted. During this second fill and index time period, aliquot parts of a 50% of total fill will be delivered to the right-hand groups of containers by the group of product distributor outlets associated with the right-hand manifold 48R and, at the same time, the group of containers previously associated with the product distributor outlets of the left-hand manifold 48R will be indexed one position to cause the last container of the left-hand group to be discharged to the right-hand group of containers and the remaining containers of the left-hand group to be indexed to their next adjacent position. The above cycle of steps is repeated until the desired number of containers have been discharged from the machine. Thus, in this machine variant, the pump 30 is alternately dosing one half of the total fill volume between two halves of the machine. In a sense, the pump 30 is time shared between two container index stacks. This results in cutting the absolute fill time in half if the same pump was used in the previously discussed embodiment in connection with this figure. Viewed differently, it allows the pump size, that is to say its flow rate, to be reduced by half, while still producing the same absolute flow rate and fill time as the embodiment discussed immediately above. Reducing pump size can, in many cases, allow a greater span of volumetric fills with volumetric accuracy to within at least one-half of one percent, since the volumetric displacement per unit of incremental rotation is reduced. In effect resolution of the volumetric metering or dosing system is increased.

FOURTH EMBODIMENT

Figure 13:
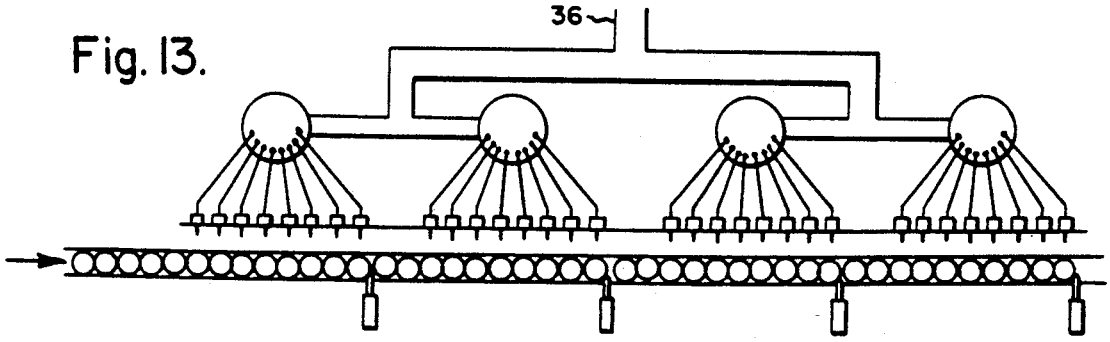
FIG. 13 is a partial diagrammatic view of a fourth structural embodiment.

The embodiment shown in FIG. 13 corresponds essentially to the last described embodiment of FIG. 12 except that one-half of the total fill of material delivered when bypass valve 182 is closed is not directed to a single manifold, either 48L or 48R but is in face delivered to two manifolds. Thus, if it is not possible to properly fill the containers with a one-half fill of material with the maximum number of nozzles that can be associated with a single manifold and stop, a second manifold is added along with a second stop. Thus, the filling nozzle shut-off valves associated with the two groups of nozzles 56 which extend from manifolds 48L1 and 48L2 are operated simultaneously to deliver aliquot parts of one-half of a total fill to the groups of containers associated with the stops 22L1 and 22L2 while the groups of containers associated with the right-hand stops 22R1 and 22R2 are indexed one position during the same time period.

FIFTH EMBODIMENT

Figure 14:
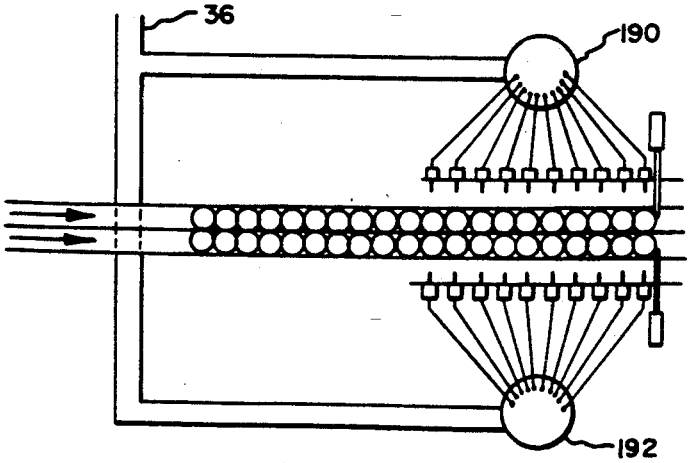
FIG. 14 is a partial diagrammatic view of a fifth structural embodiment.

While pump size can be halved by time sharing it between two manifolds in the situation where pump output is delivered to either manifold 48L or 48R as described in connection with FIG. 12, it should be appreciated that output may be substantially increased by utilizing a two-row system and filling one row while indexing the other. This system is illustrated in FIG. 14, and it should be appreciated initially that a pump is used which has an output which is substantially double that of the FIG. 12 configuration. Thus, for example, while a 5-gallon per minute pump may be utilized in the design shown in FIG. 12 when alternately delivering to manifolds 48R and 48L, a 10-gallon per minute pump may be utilized in the design shown in FIG. 14. Thus, in this design a total fill of liquid will be delivered to manifold 190 while indexing those containers associated with manifold 192. At the completion of the fill time, or of the index time, which ever is longer, the cycle will be reversed and a total fill of liquid will be delivered to the manifold 192 while the containers associated with manifold 190 are indexed one position thereby discharging one manifold. It should be appreciated that with this design, because of the dual lane setup, twice as many containers of the same size will be discharged in a given interval of time.

While the principle of the present invention should be apparent to those having ordinary skill in the art from a consideration of the above detailed description, it should be apparent that other variations may occur to those having ordinary skill in the art. For example, a dosing means utilizing a time flow from either a gravity reservoir or pressurized reservoir may be employed. Alternatively, pumps other than a rotary positive displacement pump may be used. Therefore, it is to be understood that this invention is not to be limited to the particular details shown and described above, but that, in fact, widely differing means may be employed in the broader aspects of this invention.

What is claimed is:

1. A method of filling at least one row of containers with liquid material comprising the following steps:

(a) providing at least a single dosing means for said at least one row of containers and a product distributor associated with each row of containers, each product distributor including at least one group of a plurality of product distributor outlets associated with a row of containers, the dosing means being capable of delivering a precise proportion of a total fill of liquid material during a fill-time period to the product distributor associated therewith, the total fill of liquid material being equal to the quantity of liquid material with which one container of the row of containers is to be filled;

(b) delivering a precise proportion of a total fill of liquid material during a first fill-time period from the dosing means to the product distributor to cause aliquot parts of liquid to be delivered simultaneously with the delivery of the precise proportion by at least one group of the product distributor outlets of said product distributor to a group of adjacent containers in an associated row of containers, each aliquot part being less than the total fill, and the sum of the aliquot parts delivered equaling the precise proportion of a total fill;

(c) indexing the group of adjacent containers in at least one row after the completion of the preceding step; and (d) sequentially repeating steps b and c until the leading container of the group of adjacent containers is discharged from at least one row.

2. A method of filling first and second parallel rows of containers, said method comprising:

(a) providing a single dosing means and first and second product distributors associated with the first and second parallel rows of containers, respectively, the dosing means being capable of delivering a precise proportion of a total fill of liquid during a fill- and index-time period, and each product distributor including a manifold and a plurality of product distributor outlets, each manifold having a single inlet port and a plurality of discharge ports, each discharge port being connected to a product distributor outlet;

(b) delivering a precise proportion of a total fill of liquid to the inlet port of the manifold of the first product distributor during a first fill- and index-time period to cause aliquot parts of liquid to be delivered simultaneously with the delivery of the precise proportion by the product distributor outlets of the first product distributor to a group of adjacent containers in the first row of containers and simultaneously indexing the second row of containers to cause the leading container of the row to be discharged while the remaining containers in the second row are shifted one position, each aliquot part being less than the total fill, and the sum of the aliquot parts delivered equaling the precise proportion of a total fill;

(c) after the completion of the first time period and during a second fill- and index-time period delivering from the dosing means a precise proportion of a total fill of liquid to the inlet port of the manifold of the second product distributor to cause the aliquot parts of liquid to be distributed simultaneously with the delivery of the precise proportion by the product distributor outlets associated with the product distributor to a group of adjacent containers in the second row, and simultaneously indexing the first row of containers to cause the leading container in the first row to be discharged and the other containers in the first row to be indexed one position, each aliquot part being less than the total fill, and the sum of the aliquot parts delivered equaling the precise proportion of a total fill; and (d) sequentially repeating steps b and c.

3. A method of filling a row of containers which travel in a single file with liquid material comprising the following steps:

(a) providing a dosing means and a product distributor, the product distributor including a plurality of product distributor outlets, each outlet including a filling nozzle cutoff valve and a nozzle, the dosing means being capable of delivering a precise proportion of a total fill of liquid material to the product distributor during a fill-time period, the dosing means including a source of liquid under continuous pressure, said source being a pump in continuous operation, a liquid line extending from the source to the product distributor, a bypass in the liquid line and a bypass valve shiftable between open and closed positions;

(b) shifting the bypass valve from an open position to a closed position and then back to an open position during the fill-time period and while the bypass valve is closed shifting a group of adjacent filling nozzle cutoff valves from a closed position to an open position and then back to a closed position to cause a precise proportion of a total fill of liquid material to be delivered to the product distributor and to cause aliquot parts of liquid material to be delivered simultaneously with the delivery of the precise proportion by the product distributor outlets associated with said valves to a group of containers which are maintained in association with said product distributor outlets during the fill-time period, the total fill of liquid material being equal to the quantity of liquid material with which one container of the row of containers is to be filled, each aliquot parts being less than the total fill so that each containers is only partially filled during a fill-time period, and the sum of the aliquot parts being a precise proportion of a total fill;

(c) after the completion of step b, indexing the containers of the row during an index-time period; and (d) sequentially repeating steps b and c.

4. An apparatus for step filling a row of containers with liquid material comprising:

dosing means for delivering a precise proportion of a total fill of liquid material during a fill-time period, the total fill being equal to the liquid material with which one container is to be filled;

a product distributor assembly associated with a number of containers in a row of containers, the product distributor assembly receiving the precise proportion of a total fill of liquid from the dosing means during a fill-time period and discharging simultaneously with the delivery of the precise proportion a precise measure of liquid material in aliquot portions during the same fill-time period to the number of containers, the sum of the aliquot portions being equal to the precise proportion of a total fill of liquid material, and each aliquot portion being less than a total fill, the product distributor assembly including a plurality of product distributor outlets through which aliquot portions are discharged to a number of containers during the fill-time period; and conveying means capable of indexing a row of side-by-side containers for step filling past the product distributor outlets during an index-time period and also being capable of maintain a number of containers in association with product distributor outlets during a fill time period, each container being only partially filled during each fill-time period.

5. An in-line filling machine capable of step filling a row of containers with liquids at comparably high speeds and low cost, the row of containers traveling a single file through the machine; said filling machine comprising:

a product distributor including first and second manifolds, and first and second groups of product distributor outlets, each manifold having a single inlet port and a plurality of discharge ports, the discharge ports of the first manifold being connected to the first group of product distributor outlets and the discharge ports of the second manifold being connected to the second group of product distributor outlets;

dosing means for delivering a precise proportion of a total fill of liquid simultaneously to the inlet ports of the first and second manifolds during a fill-time period while at the same time and simultaneously with the delivery of the precise proportion causing aliquot parts of liquid, the sum of which is equal to the precise proportion of a total fill, to be delivered to a row of containers through the first and second groups of product distributor outlets, the precisely measured fill of material being divided between the first and second manifolds and each aliquot part being less than a total fill; and conveying means for performing the function during an index-time period of discharging the leading container of the row while simultaneously indexing the remaining containers of the row to the next adjacent product distributor outlets and additionally for performing the function during the fill-time period of maintaining the row of containers in association with the product distributor outlets.

6. An in-line filling machine capable of step filling a row of containers with liquids at comparably high speeds and low cost, said filling machine comprising:

a product distributor including a manifold and a plurality of distributor outlets, the manifold having a single inlet port and a plurality of discharge ports, each discharge port being connected to a product distributor outlet;

dosing means capable of delivering a precise proportion of a total fill of liquid to the inlet port of the product distributor during a fill-time period while at the same time and simultaneously with the delivery of the precise proportion causing aliquot parts of liquid, the sum of which is equal to the precise proportion of the total fill, to be delivered to a row of containers through the product distributor outlets, the dosing means including a continuous source of liquid under pressure, a fluid line extending from the source of liquid under pressure to the product distributor, a bypass connected to the fluid line between its ends, and a bypass valve shiftable between open and closed positions; and conveying means capable of either discharging the leading container of the row while simultaneously indexing the remaining containers of the row to the next adjacent product distributor outlets during an index-time period, or of maintaining the row of containers in association with the product distributor outlets during a fill-time period.

7. An in-line filling machine capable of step filling first and second parallel rows of containers with fluids at comparably high speeds and low costs; said filling machine comprising:

first and second product distributors associated with first and second parallel rows of containers, each product distributor including a manifold and a plurality of product distributor outlets, each manifold having a single inlet port and a plurality of discharge ports, each discharge port being connected to a product distributor outlet;

a single dosing means capable of delivering a precise proportion of a total fill of liquid to the inlet port of either one or the other manifold during a time period and simultaneously with the delivery of the precise proportion causing aliquot parts of liquid, the sum of which is equal to the precise proportion of the total fill to be delivered to a row of containers through the product distributor outlets associated with said one or the other manifold; and conveyor means including first and second conveying means capable of either discharging the leading container of a row while simultaneously indexing the remaining containers of the row to the next adjacent position during one time period or of maintaining the row of containers in association with either said first or second product distributors during another time period.

8. The filling machine as set forth in claim 4, claim 5, or claim 7 wherein the dosing means includes a single positive-displacement pump.

9. The filling machine as set forth in claim 4, claim 5, or claim 7 wherein the dosing means includes a continuous source of fluid under pressure, a fluid line extending from the source to a product distributor, a bypass connected to the fluid line, and a bypass valve shiftable between open and closed positions.

10. An in-line machine capable of step filling a row of containers with aliquot parts of a total fill of liquid, the in-line filling machine comprising: a frame, conveying means carried by the frame, the row of containers being supported by the conveyor for movement in an X-axis direction, dosing means capable of delivering a total fill of liquid, a product distributor including a plurality of product distributor outlets and a manifold having a single inlet port and a plurality of discharge ports, each discharge port being connected to a single product distributor outlet, and each of the product distributor outlets including a filling nozzle cutoff valve and a nozzle, and adjustable mounting means capable of adjustably positioning each nozzle in X, Y, and Z axes, the adjustable mounting means including laterally spaced apart first and second vertical supports carried by the frame adjacent the conveyor, a horizontal support carried by an upper end portion of each of the laterally spaced apart vertical supports, each horizontal support extending in a Y-axis direction transverse to the direction of movement of the conveyor, a vertically extending support rod assembly adjustably secured to each horizontal support for movement in a direction transverse to the movement of the conveyor, and a longitudinally extending nozzle support assembly adjustably secured to each of the vertically extending support rod assemblies for vertical movement, said longitudinally extending nozzle support assembly being disposed parallel to the conveyor, the longitudinally extending nozzle support assembly includes upper and lower parallel rods to which the nozzles are adjustably secured for longitudinal movement, and wherein the longitudinally extending nozzle support assembly further includes rotatable means at the ends of the upper and lower parallel rods, the rotatable means being capable of rotating the pair of rods about an X-axis disposed between the upper and lower rods whereby the nozzles may be angled with respect to the containers.

* * * * *